US011268344B2

(12) United States Patent
Patterson et al.

(10) Patent No.: US 11,268,344 B2
(45) Date of Patent: Mar. 8, 2022

(54) SYSTEM AND METHOD FOR PROVIDING ALTERNATIVE CHEMICAL INJECTION PATHS

(71) Applicants: Brandon Patterson, Midland, TX (US); Jose Cedillo, Kilgore, TX (US)

(72) Inventors: Brandon Patterson, Midland, TX (US); Jose Cedillo, Kilgore, TX (US)

( * ) Notice: Subject to any disclaimer, the term of this patent is extended or adjusted under 35 U.S.C. 154(b) by 0 days.

(21) Appl. No.: 16/855,617

(22) Filed: Apr. 22, 2020

(65) Prior Publication Data

US 2020/0378214 A1 Dec. 3, 2020

Related U.S. Application Data

(60) Provisional application No. 62/837,585, filed on Apr. 23, 2019.

(51) Int. Cl.
*E21B 33/038* (2006.01)
*E21B 34/02* (2006.01)
*E21B 43/16* (2006.01)

(52) U.S. Cl.
CPC ..... *E21B 34/025* (2020.05); *E21B 33/038* (2013.01); *E21B 43/162* (2013.01)

(58) Field of Classification Search
CPC ..... E21B 33/038; E21B 34/02; E21B 34/025; E21B 37/06; E21B 43/162
See application file for complete search history.

(56) References Cited

U.S. PATENT DOCUMENTS

| | | | | |
|---|---|---|---|---|
| 5,168,933 | A * | 12/1992 | Pritchard, Jr. | E21B 33/043 166/212 |
| 7,909,101 | B2 * | 3/2011 | Conrad | E21B 43/006 166/300 |
| 8,220,552 | B2 * | 7/2012 | Kinnari | F17D 1/05 166/367 |
| 9,388,675 | B2 * | 7/2016 | He | E21B 43/12 |
| 9,447,658 | B2 * | 9/2016 | He | E21B 37/06 |
| 10,119,375 | B1 * | 11/2018 | Hill, Jr. | E21B 17/025 |
| 2010/0101788 | A1 * | 4/2010 | Mennem | E21B 43/25 166/268 |

* cited by examiner

*Primary Examiner* — Matthew R Buck

(57) ABSTRACT

An alternative chemical injection path system that includes a conduit and a manifold. The conduit has a first injection point configured at a first distance from a first end of the conduit and a second injection point configured at a second distance from the first end, with the second distance being different than the first distance. The manifold has an inlet and first and second outlets. The inlet is configured for receiving a chemical, while the first outlet is fluidly coupled to the first injection point, and the second outlet is fluidly coupled to the second injection point. The manifold is configured to distribute the chemical to the first injection point and the second injection point according to a location of a clog in the conduit.

18 Claims, 8 Drawing Sheets

SYSTEM AND METHOD FOR PROVIDING ALTERNATIVE CHEMICAL INJECTION PATHS

CROSS REFERENCE TO RELATED APPLICATIONS

This application is related to and claims priority under 35 U.S.C. § 119 to U.S. Patent Application No. 62/837,585, filed Apr. 23, 2019 entitled "System and Method For Providing Alternative Chemical Injection Paths." Patent Application No. 62/837,585 is hereby incorporated by reference in its entirety.

TECHNICAL FIELD

This disclosure is generally directed to fluid conduit. More specifically, this disclosure is directed to a system and method of providing alternative chemical injection paths.

BACKGROUND

The oil and gas industry has a variety of conduits (including downhole conduits) that are designed to transport a fluid, for example, a production fluid. To assist such production, a chemical is often injected. Problems arise when such conduits get clogged.

SUMMARY OF THE DISCLOSURE

According to one embodiment, an alternative chemical injection path system includes a conduit and a manifold. The conduit has a first injection point configured at a first distance from a first end of the conduit and a second injection point configured at a second distance from the first end, with the second distance being different than the first distance. The manifold has an inlet and first and second outlets. The inlet is configured for receiving a chemical, while the first outlet is fluidly coupled to the first injection point, and the second outlet is fluidly coupled to the second injection point. The manifold is configured to distribute the chemical to the first injection point and the second injection point according to a location of a clog in the conduit.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The phrase "at least one of," when used with a list of items, means that different combinations of one or more of the listed items may be used, and only one item in the list may be needed. For example, "at least one of: A, B, and C" includes any of the following combinations: A; B; C; A and B; A and C; B and C; and A and B and C. Definitions for certain words and phrases are provided throughout this patent document, those of ordinary skill in the art should understand that in many if not most instances, such definitions apply to prior, as well as future uses of such defined words and phrases.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The FIGURES described below, and the various embodiments used to describe the principles of the present disclosure in this patent document are by way of illustration only and should not be construed in any way to limit the scope of the disclosure. Those skilled in the art will understand that the principles of the present disclosure invention may be implemented in any type of suitably arranged device or system. Additionally, the drawings are not necessarily drawn to scale.

Figure 1:
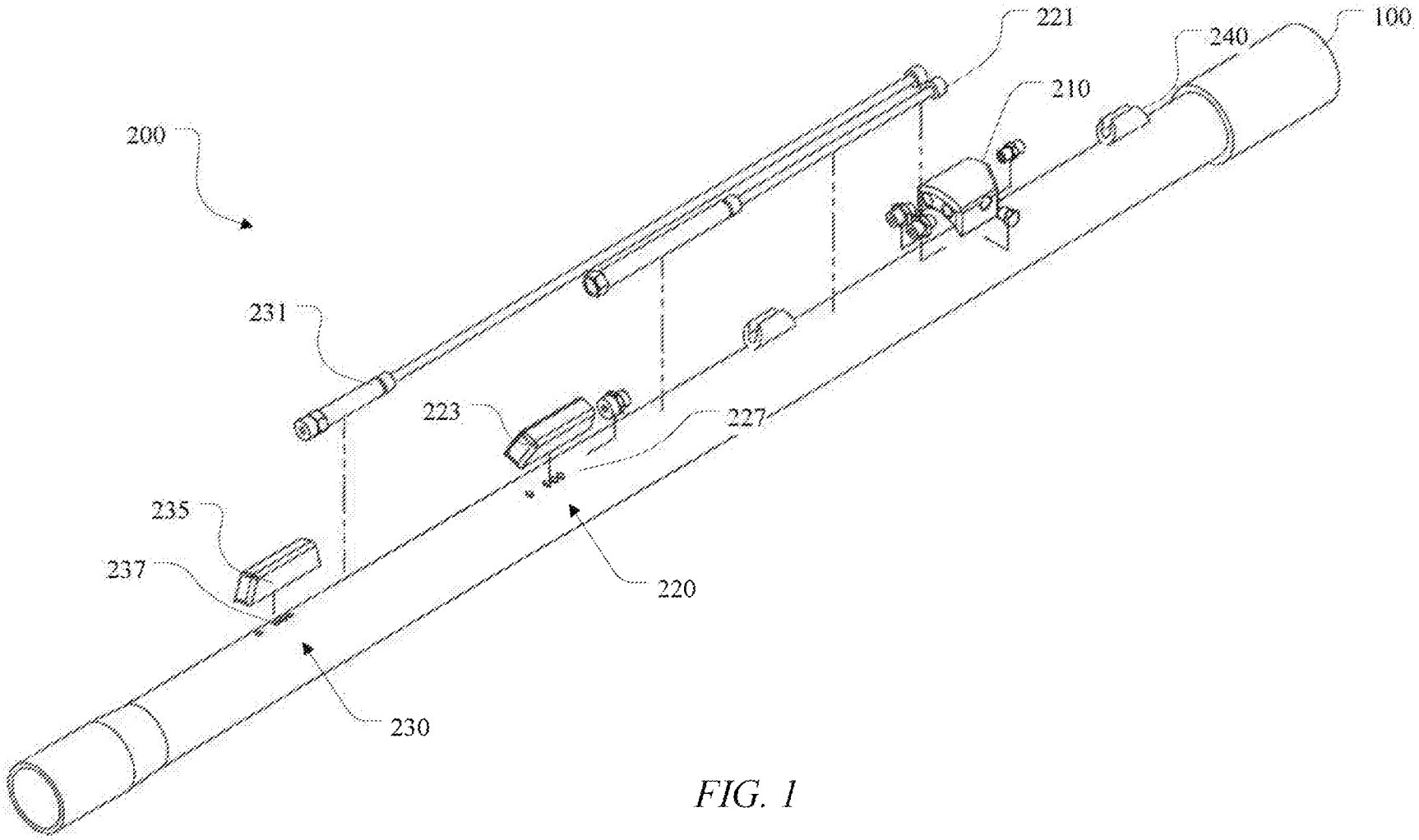
FIG. 1 shows a system that provides chemical injection points in a conduit, according to one embodiment of the present disclosure.

FIG. 1 shows a system 200 that provides chemical injection points in a conduit 100, according to embodiments of the disclosure.

FIG. 1 shows a conduit 100 that, for example, may be used for the transport of fluids. The right of FIG. 1 generally corresponds to a downstream point whereas the left of FIG. 1 generally corresponds to an upstream point. Stated differently, the fluid flow from left to right with respect to FIG. 1. When the conduit 100 is down-hole, the left side of the conduit 100 of FIG. 1 is further downhole and the right side is closer to the surface.

To advantageously assist with such fluid flow, chemicals may be injected into the conduit 100 for a variety of reasons. In the case of downhole operations, such chemical injection is performed at a certain preferred location or locations—usually measured in feet from the surface. To inject chemicals into the conduit, capillary tubing (or other similar chemical injection line) can be ran downhole in parallel with the conduit. In operation, for a variety of reasons, either the capillary tubing (or other similar chemical injection line) and/or conduit may become clogged. As a non-limiting example, conduits can clog at check valves. Accordingly, embodiments of the disclosure provide alternative injection points to ensure chemical is received in the conduit.

Although chemicals are generally described with reference to certain configurations, it should be expressly understood that a variety of types of fluids may be "injected" and avail from embodiments of the disclosure. For purposes of illustration only, "fluid" will be used to describe flow through the conduit whereas "chemical" will describe the material that is injected. Also, while the twit "injection" is used, in certain embodiments, such injection occurs inside of the conduit whereas, in other embodiments, injection occurs outside the conduit and may be enter an interior through a sucking of the fluid into an interior of the conduit.

The system 200 generally includes a manifold 210 that receives a chemical and first directs such chemicals to one or both of a first injection point 220 and a second injection point 230. In certain configurations, the second injection point 230 may be a preferred injection point and is further upstream (or downhole). Operationally, chemicals enter the manifold 210, for example, through upstream tubing (e,g., capillary tubing in some embodiments) that is not shown. If fluid flow through the conduit 100 is adequate (e.g., as will be described below), the manifold directs chemicals into the second injection point 230. However, if the conduit 100 and/or capillary tubing begins to become clogged, the manifold directs the chemical to the alternative (first) injection point 220. In particular configurations, the manifold 210 itself detects the pressure change in the interior of the pipe and/or its own capillary tubing.

While the injections points have been described with a certain arrangement as "preferred" and "alternative" injection points, operationally they may be switched for a variety of reasons according to this disclosure. Thus, in particular configurations, injection point 220 may be the preferred and injection point 230 can be the alternative. In such an alternative configuration, a switch form a downstream to an upstream may be used to help clear a clog.

The manifold 210 may operate in a variety of different manners to switch between the alternative fluid paths. In one configuration, the lack of pressure (e.g., because of lack of fluid flow) forces a switch from one to the other (e.g., second injection point 230 to first second point 220). As one example, in one configuration, once the clog has been removed, the detected pressure change to normal may allow the manifold to switch back to primary flow through injection point 230. Again, as described above, the preferred injection point (or points) may be either point (or points)—depending on the operators' goal.

To allow the chemical injection into the second injection point 230, the chemical may travel through a second path 231, a second connection piece 233, and one or more holes 237. Similarly, to allow the chemical injection into the first injection point 220 (which may be the alternative path), the chemical may travel through a first path 221, a first connection piece 225, and one or more holes 227. These pieces are shown disconnected from the conduit 100 for the purpose of illustration. After reviewing this disclosure, one of ordinary skill in the art will recognize how such components may be placed on the conduit 100. For example, in one configuration, the one or more holes 227, 237 may be created (e.g., drilled) in an existing conduit 100 and retrofitted with the additional pieces, for example, with welding, Path clips 240 may also be added for the tubing associated with the system 200.

Each of the first and second paths 221, 231 may include any suitable type of piping structure for fluidly coupling the outlets of the manifold 210 to the one or more holes 227, 237, respectively. In a particular example, each of the first and second paths 221, 231 include an elongated section of tubing, such as ½ inch inside diameter (ID) steel tubing. Nevertheless, it should be appreciated that other sizes of tubing or pipe may be implemented having any suitable inside diameter size for conveying the chemical from the manifold 210 to the one or more holes 227, 237. In certain configurations, the paths for the fluids may be referred to as capillary tubing. In other configurations, such paths may be alternatively named.

In particular configurations, the respective flows between paths 221, 231 is not an all-or-nothing approach. Rather, the manifold 210 may circulate a degree of the chemicals, for example, as pressure changes. For example, for low pressures upstream, a relatively larger amount (or all) of the chemicals may be sent upstream for injection at a preferred point. Then, that relative amount may proportionally change with the increase of pressure upstream until, for example, the upstream preferred path is not used at all. Rather, the downstream path is used. This configurations my continue until, for example, the pressure alleviates and the contrary happens where the preferred upstream point is used again. As referenced above, the preferred and alternative injection points can alternatively be changed based on operation. In different configurations, the alternative points may be reversed in upstream/downstream preference.

While a proportional change is described in some configurations, in other configurations, the change may not be proportional. And, after having reviewed this disclosure, one of ordinary skill in the art will recognize that a variety of other configurations may be used in the manifold, including the ability to set and/or change biasing mechanisms associated with the manifold 210.

While a certain distance has been shown between the first injection point 220 and the second injection point 230, other distances may be used. And, while both injection points 220, 230 are shown on the same conduit segment, they may be located on a different segment.

Figure 2:
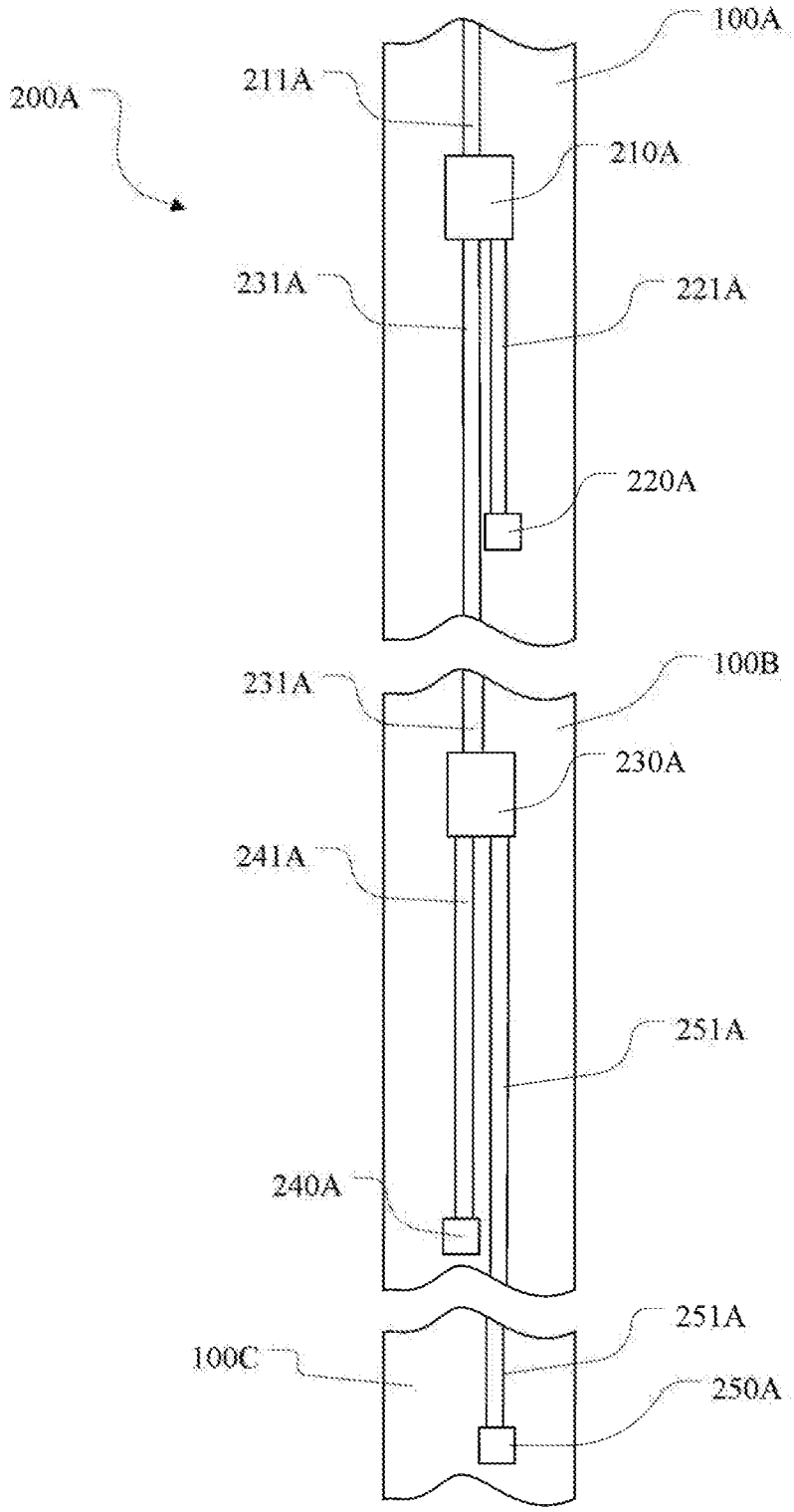
FIG. 2 schematically illustrations an alternative configuration 200A with daisy chaining.
Figure 2A:
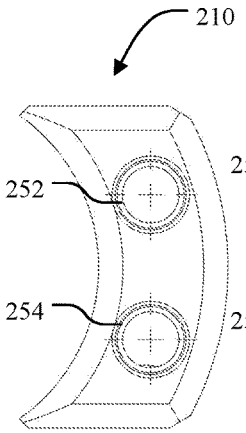
Figure 2B:
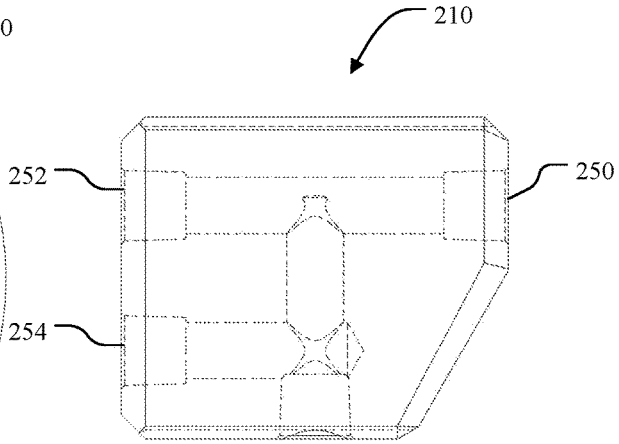
Figure 2C:
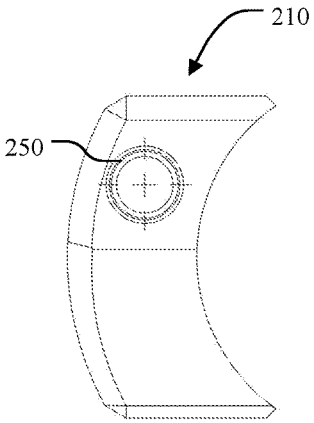
Figure 2D:
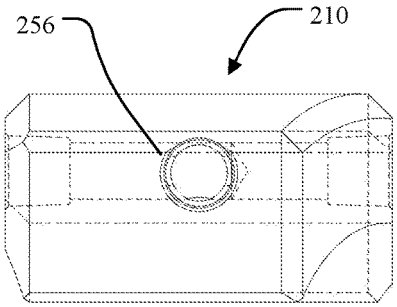

FIG. 2 schematically illustrations an alternative configuration 200A with daisy chaining. For purpose of illustration, the components are shown as blocks. A conduit is shown in three pieces 100A, 100B, and 100C with a curved-line indicating lengths of the conduit not shown. Operationally, there are similarities to FIG. 1 except that two manifolds 210A, 231A are used in a daisy chained manner. Thus, in this configuration, injection point 250A may be preferred with injection pint 240A being the next preferred and, finally, injection point 220A being the last preferred. The manifolds 210A, 230A themselves may operate as described above in switching depending on pressures. Further details of manifold designs are, also, provided herein. The paths for chemical injection are shown as 211A, 221A, 231A, 241A, and 251A respectively leading to their component—either an injection point or a manifold. While only three alternative injection points with two manifolds are shown, in particular configurations, more than two manifolds and more than three injection points may be utilized.

Figure 3:
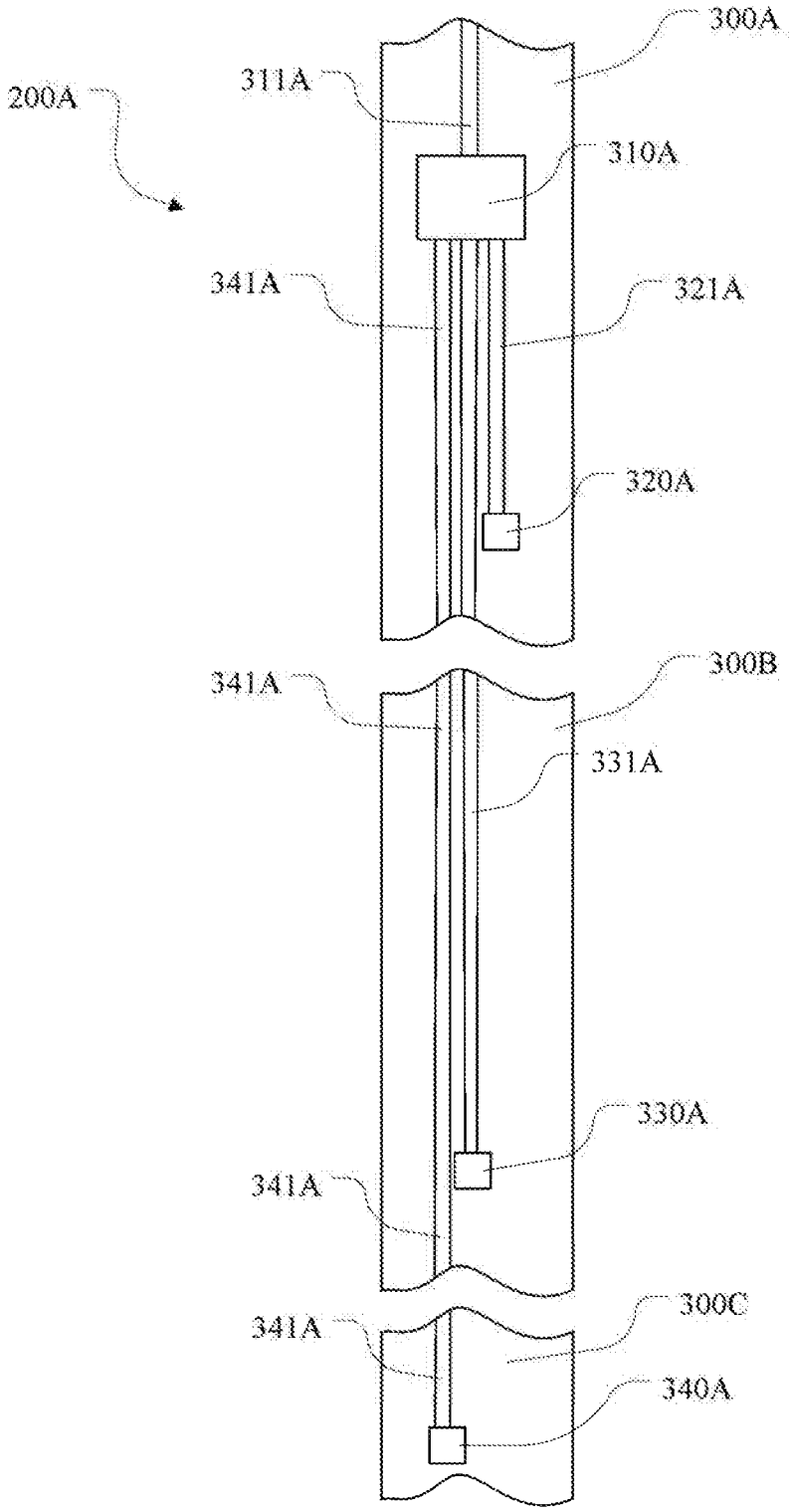
FIG. 3 schematically illustrates an alternative configuration with a manifold with three alternative paths FIG. 4 schematically illustrations an alternative configuration with redundant paths.

FIG. 3 schematically illustrates an alternative configuration with a manifold with three alternative paths. For purpose of illustration, the components are shown as blocks. A conduit is shown in three pieces 300A, 300B, and 300C with a curved-line indicating lengths of the conduit not shown. Operationally, there are similarities to FIG. 1 and FIG. 2 except that a manifold 310A has at least three outputs paths for three points, injection point 340A, 330A, and 340A. Just like the description with other embodiments, these alternative paths can be chosen selectively in either a proportional or non-proportional manner. The paths for chemical injection are shown as 311A, 321A, 331A, and 341A, and 251A respectively leading to their component—either an injection point or manifold.

Figure 4:
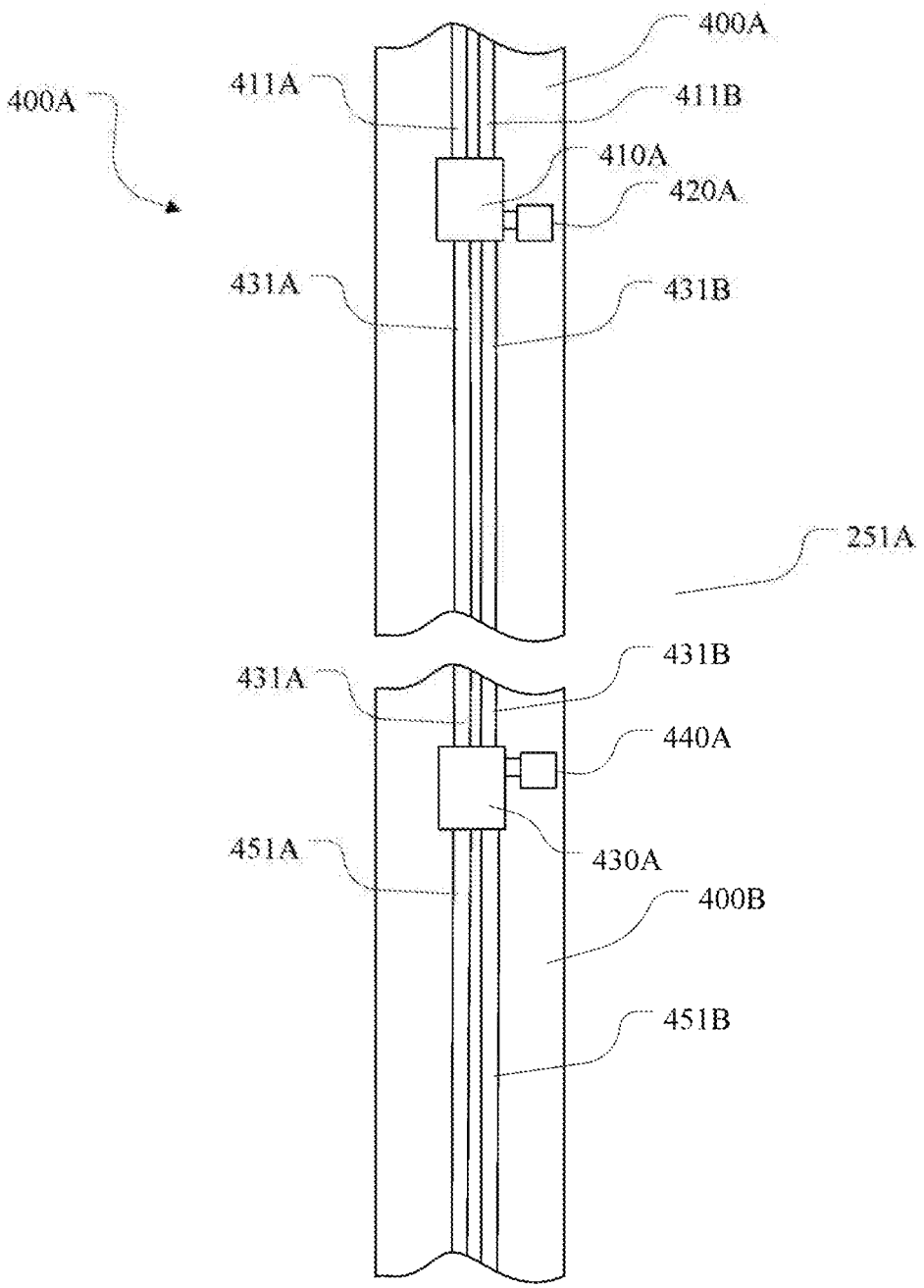

FIG. 4 schematically illustrations an alternative configuration with redundant paths. For purpose of illustration, the components are shown as blocks. A conduit is shown in two pieces 400A and 400B with a curve-line indicating lengths of the conduit not shown. Operationally, there are similarities to FIG. 1 and FIG. 2 except that redundant lines (e.g., 411A/411B, 431A/431B, 451A/451B) are ran to, from, and between manifolds 410A and 430A. Each manifold can have an injection point 420A and 440A (which can be close to or a distance from the manifold). In configurations such as this, the redundant lines may be seen as failover and/or switching manifolds. The paths for chemical injection are shown as 411A/411B, 431A/431B, and 451A/451B respective leading to or from a component.

With reference to the above figures, any select components and concepts can be combined with other configurations. As an example, a triple-manifold design can be used with daisy chaining; and, select paths can have redundant pipes. Also, while injection directly into a conduit is generally described, in particular configurations with any of the design described herein, the injection point can be on the exterior of the conduit and, for example, sucked into the pipe with other fluids. Such a configuration may be particularly useful for drilling scenarios.

Figure 5A:
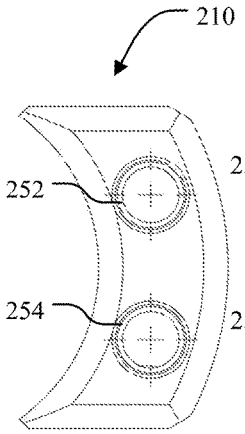
FIGS. 5A, 5B, 5C, and 5D illustrate an example manifold that may be configured on the conduit of FIG. 1 according to an embodiment of the present disclosure.
Figure 5B:
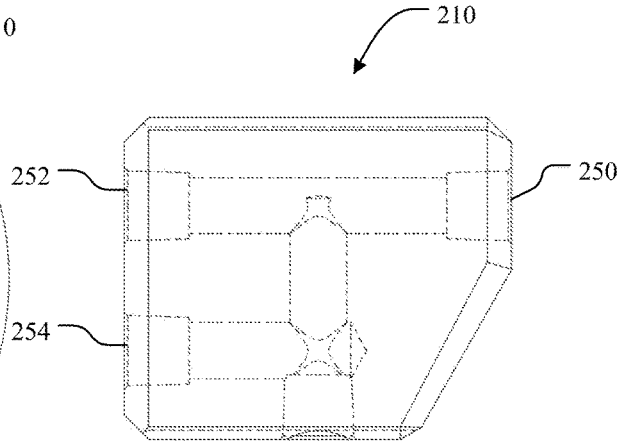
Figure 5C:
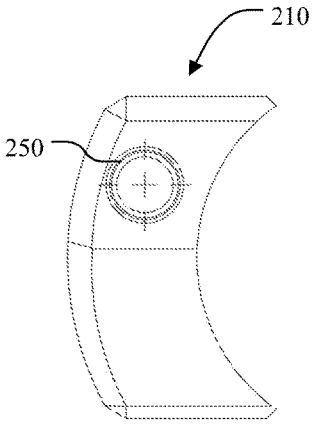
Figure 5D:
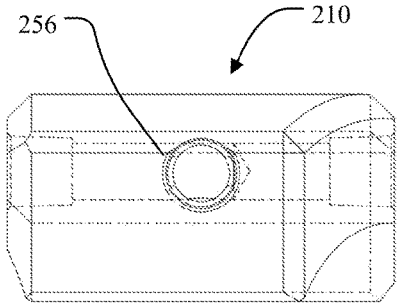

FIGS. 5A, 5B, 5C, and 5D illustrate an example manifold 210 according to an embodiment of the present disclosure. In particular, FIG. 5A illustrates a down-hole facing side view of the manifold 210, FIG. 5B illustrates a plan view of the manifold 210, FIG. 5C illustrates an upward facing side view of the manifold 210, and FIG. 5D illustrates a lateral side view of the manifold 210. The manifold 210 includes an inlet 250, and first and second outlets 252, 254. As best shown in FIG. 5B, the manifold 210 includes a pressure detection and control mechanism 256 that distributes a chemical entering at the inlet 250 between the two outlets 252, 254.

For example, the pressure detection and control mechanism 256 detects a relative difference in pressures seen at outlets and adjusts the flow of chemical to the outlets 252, 254 to alleviate the relative change in pressure. In many cases, the relative change in pressure present between the two outlets 252, 254 are indicative of a clog between the injection points 220, 230. The pressure detection and control mechanism 256 is responsive to this perceived change in pressure to adjust the flow through the outlets 252, 254 so that the clog can be alleviated. In some embodiments, the pressure detection and control mechanism 256 is responsive to this change in pressure to proportionally adjust the flow through the outlets 252, 254 according to a corresponding proportional change in detected pressure.

Figure 6A:
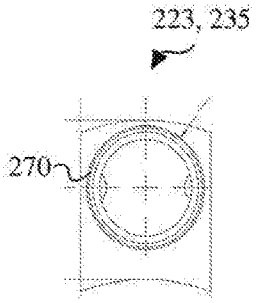
FIGS. 6A, 6B, 6C, and 6D illustrate an example connection piece that may be configured on the conduit of FIGURE 1 according to one embodiment of the present disclosure.
Figure 6B:
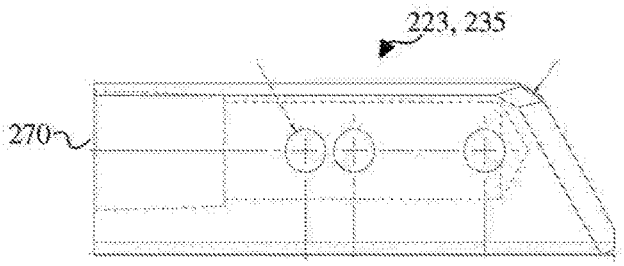
Figure 6C:
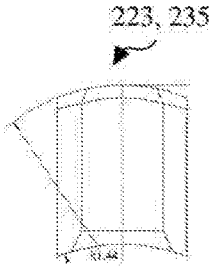
Figure 6D:
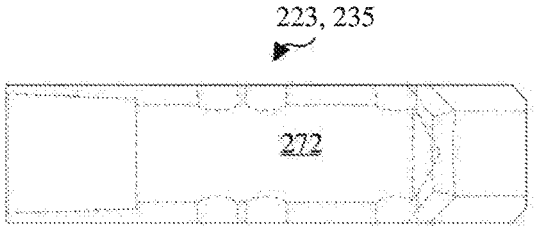
Figure 7A:
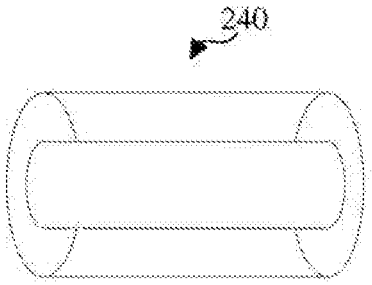
FIGS. 7A, 7B, and 7C illustrate an example path clip that may be configured on the conduit of FIG. 1 according to one embodiment of the present disclosure.
Figure 7B:
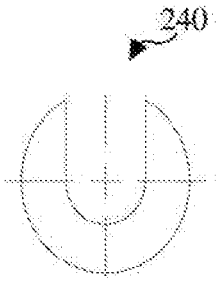
Figure 7C:
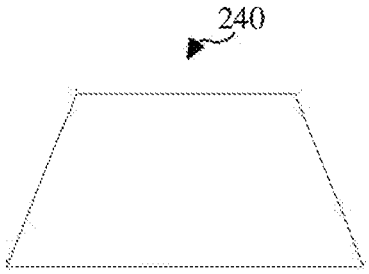

FIGS. 6A, 6B, 6C, and 6D illustrate an example connection piece 223, 235 that may be configured on the conduit 100 of FIG. 1. In particular, FIG. 6A is a down-hole facing side view of the connection piece 223, 235, FIG. 6B is a lateral side view of the connection piece 223, 235, FIG. 6C is an upward facing side view of the connection piece 223, 235, and FIG. 6D is a plan view of the connection piece 223, 235. The connection piece 223, 235 includes an inlet 270 for receiving a chemical from the manifold 210 and a cavity 272 for fluidly coupling the inlet 270 to the injection points 220, 230.

FIGS. 6A, 6B, and 6C illustrate an example path clip 240 that may be configured on the conduit 100 of FIG. 1. In particular, FIG. 6A illustrates a plan view of the path clip 240, FIG. 6B illustrates a downhole facing side view of the path clip 240, and FIG. 4C illustrates a lateral side view of the path clip 640.

The connection pieces 223, 235 and path clips 240 may be made of any suitable material. In one embodiment, the connection piece 223, 235 and path clips 240 are made of a material similar to that of the conduit 100 so that the connection piece 223, 235 can be attached to the conduit 100 using a welding technique. For example, if the conduit 100 is made of standard carbon steel, the connection pieces 223, 235 and path clips 240 would also be made of standard carbon steel so that they could be welded to the side surface of the conduit 100.

In one embodiment, the manifold 210, paths 221, 231, connection pieces 223, 235, and path clips 240 are provided to the user separately from how the conduit 100 is provided to the user. The structure and size of the conduit 100 can vary widely for different applications. Given an oil/gas well production application, for example, the sizes of conduit 100 often range from 1.0 inches to 8.0 inches in diameter. Thus, it would be beneficial to provide the manifold 210, paths 221, 231, connection pieces 223, 235 and path clips 240 as a separate system so that the user can configure those components on the type of conduit 100 that is ideally suited for their specific application. For example, once the user obtains the manifold 210, paths 221, 231, connection pieces 223, 235, and path clips 240, he or she can attach the manifold 210, paths 221, 231, connection pieces 223, 235, and path clips 240 using a welding technique, or other suitable bonding mechanism in the field where the conduit 100 is to be used. For the connection pieces 223, 235, the user could first drill holes in the conduit 100, and weld the connection pieces 223, 235 over the holes so that the injection points 220, 230 are created by forming a pressure-tight seal between the cavity 272 and the holes formed in the conduit 100.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An alternative chemical injection path system comprising:

a conduit comprising a first injection point configured at a first distance from a first end of the conduit and a second injection point configured at a second distance from the first end, the second distance being different than the first distance; and a manifold having an inlet and first and second outlets, the inlet configured for receiving a chemical, the first outlet fluidly coupled to the first injection point, and the second outlet fluidly coupled to the second injection point, wherein the manifold is configured to distribute the chemical to the first injection point and the second injection point according to a location of a clog in the conduit, and wherein the manifold is configured to detect the location of the clog according to a relative change in pressure between the first injection point and the second injection point.

2. The alternative chemical injection path system of claim 1, wherein the conduit comprises a plurality of elongated segments, the first injection point configured on a first segment of the plurality of elongated segments and the second injection point configured on a second segment of the plurality of segments.

3. The alternative chemical injection path system of claim 1, wherein each of the first and second injection points comprises one or more holes configured in the conduit.

4. The alternative chemical injection path system of claim 3, wherein each of the first and second outlets are fluidly coupled to the one or more holes via an elongated section of tubing and a connection piece.

5. The alternative chemical injection path system of claim 4, wherein the manifold, the connection pieces, and the elongated sections of tubing are provided to a user separately of how the conduit is provided to the user, wherein each of the connection pieces are fluidly coupled to the conduit using a welding technique.

6. The alternative chemical injection path system of claim 1, wherein the chemical comprises a clog alleviating material.

7. The alternative chemical injection path system of claim 6, wherein the conduit is configured in an oil or gas production well.

8. The alternative chemical injection path system of claim 1, further comprising a second manifold, wherein an inlet of the second manifold is fluidly coupled to the second outlet of the first manifold, the second injection point is fluidly coupled to a first outlet of the second manifold, and a third injection point is fluidly coupled to a second outlet of the second manifold, the third injection point configured at a third distance from the first end of the conduit, the third distance being different than the first distance and the second distance.

9. The alternative chemical injection path system of claim 1, wherein the manifold is configured to proportionately distribute the chemical between the first injection point and the second injection point.

10. An alternative chemical injection method comprising:

providing a manifold having an inlet and first and second outlets, the inlet configured for receiving a chemical, the first outlet fluidly coupled to a first injection point of a conduit, and the second outlet fluidly coupled to a second injection point of the conduit, the first injection point configured at a first distance from a first end of the conduit and the second injection point configured at a second distance from the first end, the second distance being different than the first distance;

detecting, using the manifold, a location of the clog according to a relative change in pressure between the first injection point and the second injection point; and distributing, using the manifold, the chemical to the first injection point and the second injection point according to the location of the clog in the conduit.

11. The alternative chemical injection method of claim 10, further comprising:

configuring the first injection point on a first segment of a plurality of elongated segments comprising the conduit; and configuring the second injection point on a second segment of the plurality of segments.

12. The alternative chemical injection method of claim 10, further comprising configuring one or more holes in the conduit for each of the first and second injection points.

13. The alternative chemical injection method of claim 12, further comprising fluidly coupling each of the first and second outlets to the one or more holes via an elongated section of tubing and a connection piece.

14. The alternative chemical injection method of claim 13, further comprising:

providing the manifold, the connection pieces, and the elongated sections of tubing to a user separately of how the conduit is provided to the user; and fluidly coupling each of the connection pieces to the conduit using a welding technique.

15. The alternative chemical injection method of claim 10, wherein the chemical comprises a clog alleviating material.

16. The alternative chemical injection method of claim 15, further comprising configuring the conduit in an oil or gas production well.

17. The alternative chemical injection method of claim 10, further comprising proportionately distributing, using the manifold, the chemical between the first injection point and the second injection point.

18. An alternative chemical injection path system comprising:

a manifold having an inlet and first and second outlets, the inlet configured for receiving a chemical, the first outlet is configured to be fluidly coupled to a first injection point of a conduit, and the second outlet is configured to be fluidly coupled to a second injection point of the conduit, wherein the first injection point is configured at a first distance from a first end of the conduit and the second injection point is configured at a second distance from the first end, the second distance being different than the first distance, wherein the manifold is configured to proportionately distribute the chemical to the first injection point and the second injection point according to a location of a clog in the conduit, and wherein the manifold is configured to detect the location of the clog according to a relative change in pressure between the first injection point and the second injection point.

* * * * *